US008979476B2

(12) United States Patent
Davis et al.

(10) Patent No.: US 8,979,476 B2
(45) Date of Patent: Mar. 17, 2015

(54) WEAR REDUCTION DEVICE FOR ROTARY SOLIDS HANDLING EQUIPMENT

(75) Inventors: Mark Alan Davis, Seneca Falls, NY (US); Eugene P. Sabini, Skaneateles, NY (US); Simon Craig Caioneach Bradshaw, Seneca Falls, NY (US)

(73) Assignee: ITT Manfacturing Enterprises, LLC., Wilmington, DE (US)

( * ) Notice: Subject to any disclaimer, the term of this patent is extended or adjusted under 35 U.S.C. 154(b) by 757 days.

(21) Appl. No.: 13/187,964

(22) Filed: Jul. 21, 2011

(65) Prior Publication Data

US 2012/0051897 A1 Mar. 1, 2012

Related U.S. Application Data

(60) Provisional application No. 61/366,319, filed on Jul. 21, 2010.

(51) Int. Cl.
*F04D 7/04* (2006.01)
*F04D 29/16* (2006.01)

(52) U.S. Cl.
CPC ..... *F04D 7/045* (2013.01); *F04D 29/167* (2013.01)
USPC ..... 415/71; 415/121.1; 416/176

(58) Field of Classification Search
USPC ..... 415/121.1, 121.2, 71, 72, 143; 416/176, 416/177, 175, 202; 241/46.11, 46.17, 185.6
See application file for complete search history.

(56) References Cited

U.S. PATENT DOCUMENTS 1,879,803 A 9/1932 Johnson
2,245,035 A 6/1941 Hartman
2,975,714 A * 3/1961 Nechine ..... 241/46.02
3,447,475 A 6/1969 Blum
4,242,039 A 12/1980 Villard et al.

(Continued)

FOREIGN PATENT DOCUMENTS

CN 2489129 5/2002
CN 1461893 12/2003

(Continued)

OTHER PUBLICATIONS

English language abstract (Patent Abstracts of Japan) of 09-004585 (1 page).

(Continued)

*Primary Examiner* — Edward Look
*Assistant Examiner* — Maxime Adjagbe

(57) ABSTRACT

A pump for solids handling is provided having a suction liner in combination with an impeller. The suction liner has a suction liner spiral design. The impeller has forward curved impeller suction side pump out vanes. The suction liner spiral design and the forward curved impeller suction side pump out vanes are configured to handle solids substantially having a weight concentration (Cw)<about 40% and/or a solids size distribution <about 200 microns, and to exclude abrasive solids from an impeller/suction side liner gap by increasing the resistance to slurry flow from a high pressure area at the periphery of the impeller periphery, and expel the solids which do manage to enter the impeller/suction side liner gap by guiding the solids away from a suction eye of the impeller, so abrasive erosion is substantially prevented to significantly reduce wear and a tight clearance is substantially maintained at the impeller/suction side liner gap between the impeller and the suction liner, which prevents degradation of pump performance through excessive leakage.

11 Claims, 3 Drawing Sheets

(56) References Cited

U.S. PATENT DOCUMENTS

| | | | | |
|---|---|---|---|---|
| 4,778,336 | A | 10/1988 | Husain | |
| 5,516,261 | A | 5/1996 | Zelder | |
| 5,984,629 | A | 11/1999 | Brodersen et al. | |
| 6,190,121 | B1 | 2/2001 | Hayward et al. | |
| 6,464,454 | B1 * | 10/2002 | Kotkaniemi | 415/121.1 |
| 7,021,890 | B2 | 4/2006 | Ishigaki et al. | |
| 7,766,605 | B2 | 8/2010 | Lindskog | |

FOREIGN PATENT DOCUMENTS

| | | |
|---|---|---|
| CN | 101117966 | 2/2008 |
| GB | 1356584 | 6/1974 |
| JP | 62284995 | 12/1987 |
| JP | 2211998 | 8/1990 |
| JP | 8-232892 | 9/1996 |
| JP | 9-4585 | 1/1997 |
| JP | 2005233170 | 9/2005 |
| WO | 2005038260 | 4/2005 |
| WO | 2005045201 | 5/2005 |
| WO | 2006135304 | 12/2006 |
| WO | 2010079088 | 7/2010 |

OTHER PUBLICATIONS

English language abstract (Espacenet) of JP8232892 (1 page).
Form PCT/ISA/210 (International Search Report) dated Jan. 5, 2012 (1 page).
English language Abstract of JP2005233170 (1 page).
English language Abstract of CN101117966 (1 page).
English language Abstract of JP62284995 (1 page).
English language Abstract of JP2211998 (1 page).
English language Abstract of CN2489129 (1 page).
English language Abstract of CN1461893 (1 page).
English Language Abstract of WO2010079088 (1 page).
English Language Abstract of WO2005045201 (1page).

* cited by examiner

WEAR REDUCTION DEVICE FOR ROTARY SOLIDS HANDLING EQUIPMENT

CROSS REFERENCE TO RELATED PATENT APPLICATION

This application claims benefit to patent application Ser. No. 61/366,319, filed 21 Jul. 2010, which is hereby incorporated by reference in its entirety.

BACKGROUND OF THE INVENTION

1. Field of the Invention

This invention relates to a pump or pumping assembly, arrangement or combination; and more particularly, to an improvement to an impeller and suction liner combination used therein.

2. Description of Related Art

In pumps used for solids handling, the primary cause of reduced life and premature failure is recirculation from the outer diameter of the impeller to the suction of the impeller. The solids in the flow abrade and erode the impeller and suction liner, reducing their ability to seal and increasing the severity of the problem as additional wear occurs.

SUMMARY OF THE INVENTION

According to some embodiments, the present invention may take the form of apparatus, such as a pump or pumping assembly, arrangement or combination for solids handling, comprising a suction liner in combination with an impeller. The suction liner has a suction liner spiral design. The impeller has forward curved impeller suction side pump out vanes. The suction liner spiral design and the forward curved impeller suction side pump out vanes are configured to handle solids so as to exclude abrasive solids from an impeller/suction side liner gap by increasing the resistance to slurry flow from a high pressure area at the periphery of the impeller, and expel the solids which do manage to enter the impeller/suction side liner gap by guiding the solids away from a suction eye of the impeller, so that abrasive erosion is substantially prevented to significantly reduce wear and a tight clearance is substantially maintained at the impeller/suction side liner gap between the impeller and the suction liner, which substantially prevents degradation of pump performance through excessive leakage.

According to some embodiments of the present invention, the suction liner spiral design and the forward curved impeller suction side pump out vanes are configured to handle solids substantially have a weight concentration (Cw)<about 40% and/or a solids size distribution <about 200 microns.

According to some embodiments, the present invention may also include one or more of the following features:

The suction liner spiral design may be configured with at least one of the following: one spiral or at least two overlapping spirals.

Each overlapping spiral may be configured to start at an outer periphery of an inner rim of the spiral liner and end at an outer rim or periphery of the suction liner.

Each overlapping spiral may be configured to start at an outer periphery of the inner rim of the spiral liner and end at an intermediate location between the inner rim and the outer rim or periphery of the suction liner.

The two overlapping spirals may be configured to start at opposite sides of an outer periphery of the inner rim and end at opposite sides of the outer rim or periphery.

The impeller may be configured with an inner rim and an outer rim or periphery, and the forward curved impeller suction side pump out vanes may extend from the inner rim and end at the outer rim or periphery.

The forward curved impeller suction side pump out vanes may also be spaced equidistantly about the impeller face.

The suction liner spiral design may be configured with an outside diameter that is dimensioned relative to a suction liner outside diameter based at least partly on a percentage of best efficiency flow pumped by the pump.

The dimension of the outside diameter of the suction liner spiral design relative to the pump liner outside diameter may be inversely related to the change in the percentage of the best efficiency flow pumped by the pump.

The dimension of the outside diameter of the suction liner spiral design relative to the pump liner outside diameter may be reduced if the percentage of the best efficiency flow pumped by the pump is increased.

The dimension of the outside diameter of the suction liner spiral design relative to the pump liner outside diameter may be increased if the percentage of the best efficiency flow pumped by the pump is decreased.

The present invention disclosed herein assists in moving solids away from the area in question and thereby improving both the service lifespan and efficiency of a pump or pumping assembly, arrangement or combination. This technology is an improvement of the technology disclosed in an earlier filed patent application no. WO 2005/038260 A1, corresponding to U.S. Pat. No. 7,766,605, assigned to the assignee of the instant patent application.

For example, experimentation has indicated that forward curved pump out vanes have a wear reducing effect in some situations, as do relationships between the spiral design, pump out vane design, solids size distribution, and solids concentration by volume or weight:

- For Cw<about 40%, forward curved pump out vanes combined with a spiral-equipped suction liner reduce wear significantly.
- For solids with $D_{80}$<about 200 microns, forward curved pump out vanes combined with a spiral-equipped suction liner also reduce wear significantly, where the parameter $D_{80}$ is understood to be essentially the screen opening size that about 80% of the slurry's particles will pass through.
- For Cw>about 50%, back curved pump out vanes combined with a spiral-equipped suction liner reduce wear significantly.
- As the percentage (%) of best efficiency flow pumped by the pump changes (e.g. from a range of about 50% to 80% of $Q_{BEP}$), reducing the outside diameter of the spiral relative to the outside diameter of the suction liner reduces suction liner wear.

In slurries with a greater percentage (%) concentration by weight or volume, prevention of all suction side leakage is paramount. The designs disclosed herein act to exclude abrasive solids from the impeller/suction side liner gap by increasing the resistance to slurry flow from the high pressure area at the impeller periphery. The designs disclosed herein also expel solids which do manage to enter the gap by guiding them away from the suction eye of the impeller. By both expelling and excluding solids, abrasive erosion is substantially prevented and a tight clearance is substantially maintained at the gap between the impeller and suction side liner, which substantially prevents degradation of pump performance through excessive leakage.

These and other features, aspects, and advantages of embodiments of the invention will become apparent with reference to the following description in conjunction with the accompanying drawing. It is to be understood, however, that the drawing is designed solely for the purposes of illustration and not as a definition of the limits of the invention.

BRIEF DESCRIPTION OF THE DRAWINGS

The drawings, which are not necessarily to scale, include the following Figures.

In the following description of the exemplary embodiment, reference is made to the accompanying drawings, which form a part hereof, and in which are shown by way of illustration an embodiment in which the invention may be practiced. It is to be understood that other embodiments may be utilized, as structural and operational changes may be made without departing from the scope of the present invention.

DETAILED DESCRIPTION OF THE INVENTION

Figure 1:
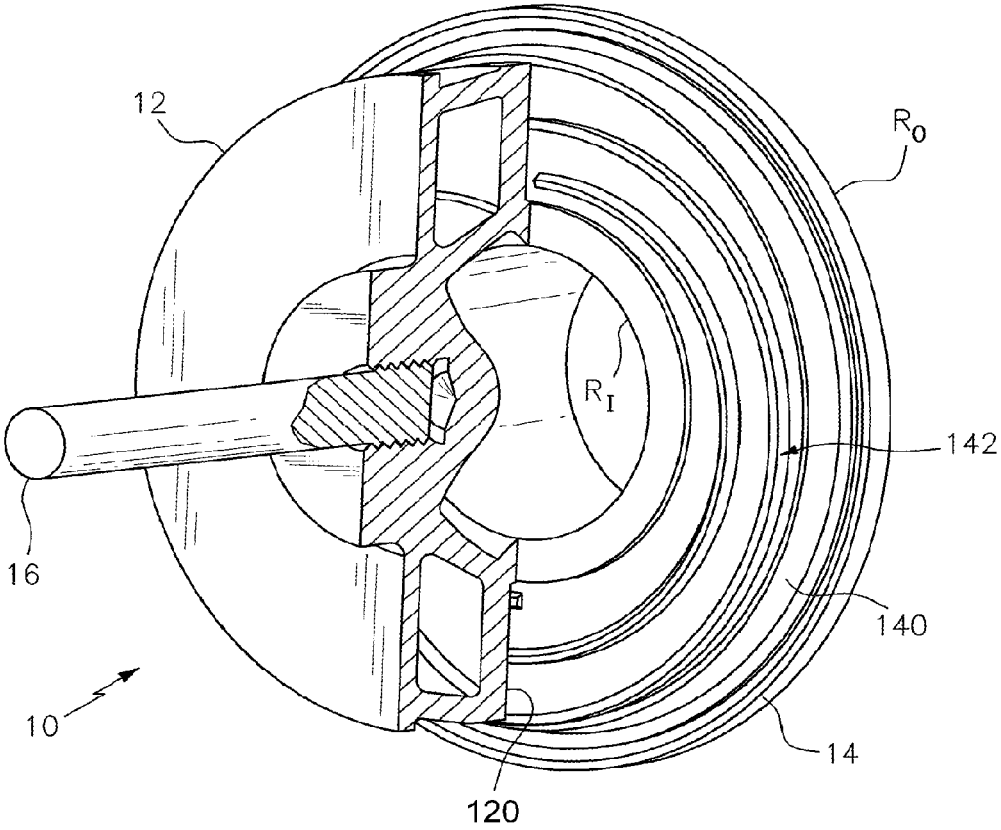
FIG. 1 is a perspective view of part of a pump or pumping assembly, arrangement or combination having an impeller (shown in cross-section) and a suction liner, according to some embodiments of the present invention.

FIG. 1 shows part of an impeller and suction liner combination generally indicated as 10 having an impeller 12 having an impeller face 120, a suction liner 14 having a suction liner face 140 and a shaft 16 arranged in the impeller 12, according to some embodiments of the present invention. Embodiments of suction liners 14', 14" are shown in greater detail in FIGS. 2*a* and 2*b*, each having a suction liner face 140', 140" with a suction liner spiral design generally indicated by arrows 144, 146. Embodiments of impellers 12', 12" are shown in greater detail in FIGS. 3*a* and 3*b*, each having respective impeller faces 120', 120" with forward curved impeller suction side pump out vanes 122 or rearward curved impeller suction side pump out vanes 124). Embodiments are also envisioned in which the impeller has straight impeller suction side pump out vanes within the spirit of the present invention. The combination is configured to form part of a pump or pumping assembly, arrangement or combination shown in FIG. 4.

According to some embodiments of the present invention, the suction liner spiral designs 142 (FIG. 1), 144 (FIG. 2*a*), and 146 (FIG. 2*b*), and the forward curved impeller suction side pump out vanes 122 are configured to handle solids, e.g., substantially having a weight concentration (Cw)<about 40% and/or a solids size distribution <about 200 microns, so as to exclude abrasive solids from an impeller/suction side liner gap by increasing the resistance to slurry flow from a high pressure area at the periphery of the impeller, and expel the solids which do manage to enter the impeller/suction side liner gap by guiding the solids away from a suction eye of the impeller, so that abrasive erosion is substantially prevented to significantly reduce wear and a tight clearance is substantially maintained at the impeller/suction side liner gap between the impeller and the suction liner, which prevents degradation of pump performance through excessive leakage.

Figure 2A:
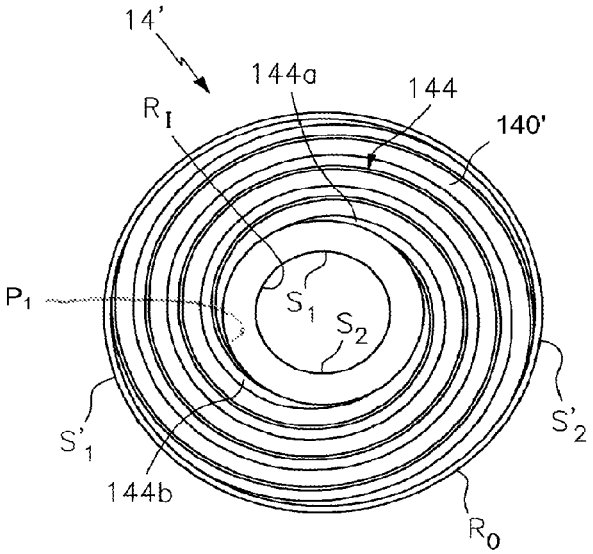
FIG. 2*a* is a plan view of a suction liner spiral design for about 50% best efficiency point (BEP) operation according to some embodiments of the present invention.
Figure 2B:
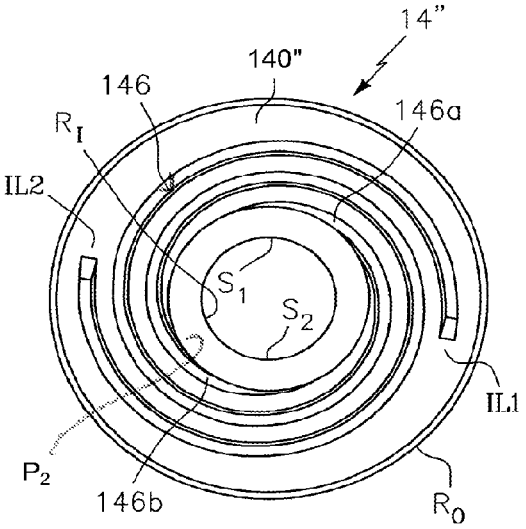
FIG. 2*b* is a plan view of a suction liner spiral design for about 80% BEP operation according to some embodiments of the present invention.

FIGS. 2*a*, 2*b*

FIG. 2*a* shows a suction liner spiral design generally indicated by the arrow 144 for about 50% best efficiency point (BEP) operation according to some embodiments of the present invention, where the suction liner spiral design 144 includes two overlapping spirals 144*a* and 144*b*.

FIG. 2*b* shows a suction liner spiral design generally indicated by the arrow 146 for about 80% best efficiency point (BEP) operation according to some embodiments of the present invention, where the suction liner spiral design 146 includes two overlapping spirals 146*a* and 146*b*.

In FIGS. 2*a* and 2*b*, the suction liners 14', 14" each have an inner rim $R_I$ and an outer rim or periphery $R_O$. In FIG. 2*a*, each overlapping spiral 144*a*, 144*b* is configured to start at an outer periphery $P_1$ of the inner rim $R_I$ and end at the outer rim or periphery $R_O$. In FIG. 2*b*, each overlapping spiral 146*a*, 146*b* is configured to start at an outer periphery $P_2$ of the inner rim $R_I$ and end at a respective intermediate location IL1, IL2 between the inner rim $R_I$ and the outer rim or periphery $R_O$.

In FIG. 2*a*, the two overlapping spirals 144*a*, 144*b* are configured to start at substantially diametrically opposite sides $S_1$, $S_2$ of the inner rim $R_I$ and end at substantially diametrically opposite sides $S_1'$, $S_2'$ of the outer rim or periphery $R_O$. Similarly, in FIG. 2*b*, the two overlapping spirals 146*a*, 146*b* are configured to start at substantially diametrically opposite sides $S_1$, $S_2$ of the inner rim $R_I$ and end at opposite intermediate locations IL1, IL2. The suction liner spiral designs in FIGS. 2*a*, 2*b* are shown by way of example, and the scope of the invention is not intended to be limited to the same. For example, embodiments are envisioned having a different number of spirals, or a different spiral configuration, within the spirit of the present invention.

In mathematics, a spiral is generally understood to be a curve which emanates from a central point, getting progressively farther away as it revolves around the point. The spirals shown in FIGS. 2*a* and 2*b* are shown by way of example as spirals that may be used in order to implement the present invention. However, embodiments are envisioned using other types or kinds of spirals either now known or later developed in the future, and designed within the spirit of the present invention without undue experimentation, including using a single spiral that may include a single curve which emanates from a central point, and get progressively farther away as it revolves around the point, or using more than two spirals that may include three curves which each emanate from a central point, and get progressively farther away as it revolves around the point. The scope of the invention is also intended to include using one or more spirals that get progressively farther away from the central point more quickly or less quickly than the curves shown in FIGS. 2*a*, 2*b*, as well as using one or more spirals that get progressively farther away from the central point having more revolutions or less revolutions about the central point than the curves shown in FIGS. 2*a*, 2*b*. Moreover, the scope of the invention is not intended to be limited to the number of spirals used in the spiral design. For example, embodiments are envisioned using one spiral, or at least two overlapping spirals, such as three or four overlapping spirals within the scope and spirit of the present invention.

Figure 3A:
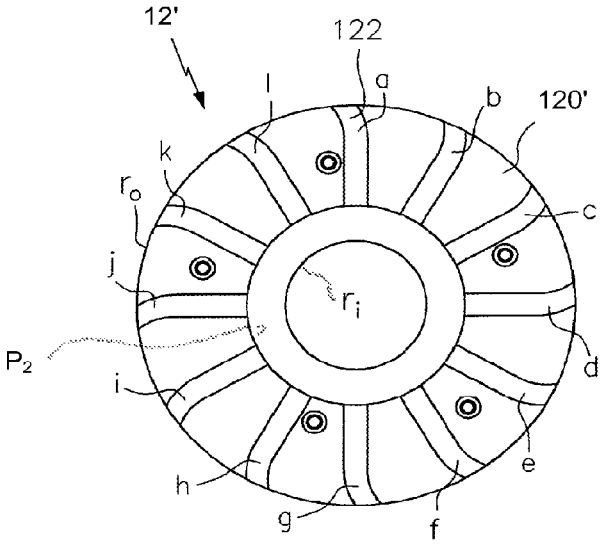
FIG. 3*a* is a plan view of forward curved impeller suction side pump out vanes according to some embodiments of the present invention.
Figure 3B:
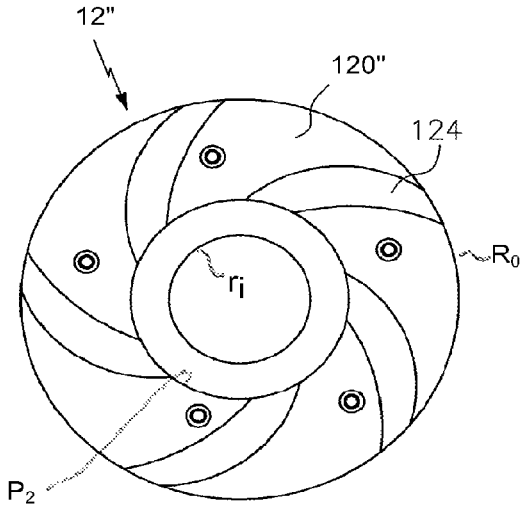
FIG. 3*b* is a plan view of rear curved impeller suction side pump out vanes according to some embodiments of the present invention.

FIGS. 3*a*, 3*b*

In FIG. 3*a*, the impeller 12' is configured with an inner rim $r_i$ and an outer rim or periphery $r_o$, and the forward curved impeller suction side pump out vanes 122*a*, 122*b*, 122*c*, . . . , 122*l* extend from an outer periphery $p_1$ of the inner rim $r_i$ and end at the outer rim or periphery $r_o$. The forward curved impeller suction side pump out vanes 122*a*, 122*b*, 122*c*, . . . , 122*l* are shown spaced equidistantly about the impeller face 120'.

In FIG. 3*a*, the forward curved impeller suction side pump out vanes 122*a*, 122*b*, 122*c*, . . . , 122*l* are shown by way of example and the scope of the invention is not intended to be limited to the same. For example, embodiments are envisioned having a different number of vanes, such as fewer than 12 vanes or greater than 12 vanes. Embodiments are also envisioned using other types or kinds of curves either now known or later developed in the future, and designed without undue experimentation within the spirit of the present invention.

Alternatively, and by way of comparison, for Cw>about 50%, the impeller 12" may be used having an impeller face 120" with five (5) back curved pump out vanes 124 (see FIG. 3*b*) combined with a spiral-equipped suction liner, consistent with that disclosed herein, may also reduce wear significantly, according to some embodiments of the present invention. Moreover, the scope of the invention is not intended to be limited to the number or shape of pump out vanes used. For example, embodiments are envisioned using less than five pump out vanes, or more than five pump out vanes, such as two, or three or four pump out vanes, as well as six, or seven, or eight pump out vanes, within the scope and spirit of the present invention and embodiments are also envisioned using pump out vanes having a different shape than that shown in FIG. 3*a*.

In FIG. 3*b*, the impeller 12" is configured with an inner rim $r_i$ and an outer rim or periphery $r_o$, and the five (5) back curved pump out vanes 124 extend from an outer periphery $p_2$ of the inner rim $r_i$ and end at the outer rim or periphery $r_o$. The five (5) rear curved pump out vanes 124 are shown spaced equidistantly about the impeller face 120", although the scope of the invention is not intended to be limited to any particular relationship between the respective rear curved pump out vanes 124. Moreover, the scope of the invention is not intended to be limited to the number or shape of back pump out vanes used. For example, embodiments are envisioned using less than five back pump out vanes, or more than five back pump out vanes, such as two, or three or four back pump out vanes, as well as six, or seven, or eight back pump out vanes, within the scope and spirit of the present invention and embodiments are also envisioned using back pump out vanes having a different shape than that shown in FIG. 3*b*.

FIG. 4

Figure 4:
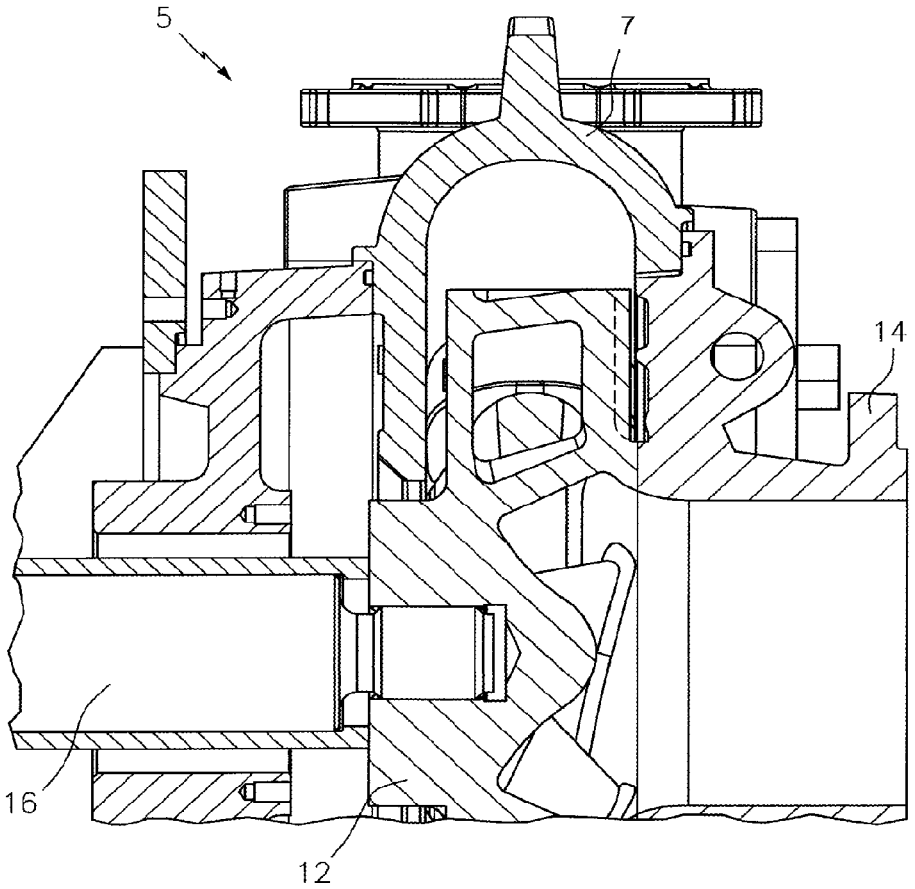
FIG. 4 is a cross-sectional view of part of a pump or pumping assembly, arrangement or combination having an impeller and a suction liner, according to some embodiments of the present invention.

FIG. 4 shows part of a pump or pumping assembly, arrangement or combination generally indicated as 5 having the impeller 12, the suction liner 14 and the shaft 16, that are arranged according to some embodiments of the present invention. The impeller 12 is arranged inside a pump liner or volute 7. In operation, a motor (not shown) rotates the impeller 12 in relation to the suction liner in order to pump a fluid containing the solids. Embodiments are also envisioned in which a double casing design may be used, e.g., such that expensive hard metal parts are contained within an outer casing of less expensive material, e.g., cast ductile iron. Embodiment are also envisioned in which rubber liners may be used, and the scope of the invention is intended to include an implementation using the same.

The Shaft/Impeller Arrangement

The arrangement between the shaft 16 and the impeller 12 is described in provisional patent application Ser. No. 61/365,947, filed 20 Jul. 2010, which was subsequently filed as regular utility application Ser. No. 13/186,647, filed on 20 Jul. 2011, claiming benefit to the earlier filed provisional application, both applications are hereby incorporated by reference in their entirety.

Scope of the Invention

Although described in the context of particular embodiments, it will be apparent to those skilled in the art that a number of modifications and various changes to these teachings may occur. Thus, while the invention has been particularly shown and described with respect to one or more preferred embodiments thereof, it will be understood by those skilled in the art that certain modifications or changes, in form and shape, may be made therein without departing from the scope and spirit of the invention as set forth above.

We claim:

1. Apparatus, including a pump or pumping assembly, arrangement or combination for solids handling, comprising:

a suction liner having a suction liner spiral design, the suction liner spiral design configured with at least one of the following; one spiral, or at least two overlapping spirals, each overlapping spiral being configured to start at an outer periphery of an inner rim of the suction liner and the end at an intermediate location between the inner rim and an outer rim or periphery of the suction liner; and an impeller having forward curved impeller suction side pump out vanes;

the suction liner spiral design and the forward curved impeller suction side pump out vanes configured to handle solids substantially having a weight concentration (Cw)<about 40% and/or a solids size distribution <about 200 microns, and to exclude abrasive solids from an impeller/suction side liner gap by increasing the resistance to slurry flow from a high pressure area at the periphery of the impeller periphery, and expel the solids which do manage to enter the impeller/suction side liner gap by guiding the solids away from a suction eye of the impeller, so abrasive erosion is substantially prevented to significantly reduce wear and a tight clearance is substantially maintained at the impeller/suction side liner gap between the impeller and the suction liner, which prevents degradation of pump performance through excessive leakage.

2. Apparatus according to claim 1, wherein each overlapping spiral is configured to start at an outer periphery of an inner rim of the suction liner and end at an outer rim or periphery of the suction liner.

3. Apparatus according to claim 1, wherein the at least two overlapping spirals are configured to start at opposite sides of an outer periphery of an inner rim of the suction liner and end at opposite sides of an outer rim or periphery of the suction liner.

4. Apparatus according to claim 1, wherein the forward curved impeller suction side pump out vanes extend from an inner rim of the impeller and end at an outer rim or periphery of the impeller.

5. Apparatus according to claim 1, wherein the forward curved impeller suction side pump out vanes are spaced equidistantly about the impeller face.

6. Apparatus, including a pump or pumping assembly, arrangement or combination for solids handling, comprising:

a suction liner having a suction liner spiral design, the suction liner spiral design configured with: one spiral, or at least two overlapping spirals, the spiral liner has an inner and outer rims, and each overlapping spiral is configured to start at the outer periphery of the inner rim and end at an intermediate location between the inner and outer rims; and an impeller having rearwardly curved impeller suction side pump out vanes;

the suction liner spiral design and the rearwardly curved impeller suction side pump out vanes configured with the suction liner spiral design to reduce wear significantly.

7. Apparatus according to claim 6, wherein the spiral liner has inner and outer rims, and each overlapping spiral is configured to start at an outer periphery of an inner rim and end at an outer rim.

8. Apparatus according to claim 6, wherein the spiral liner has inner and outer rims, and the at least two overlapping spirals are configured to start at opposite sides of an outer periphery of the inner rim and end at opposite sides of the outer rim.

9. Apparatus, including a pump or pumping assembly, arrangement or combination for solids handling, comprising:

a suction liner having a suction liner spiral design, the suction liner spiral design configured with at least two over lapping spirals, the spiral liner having inner and outer rims, and each overlapping spiral being configured to start at the outer periphery of the inner rim and end at an intermediate location between the inner and outer rims, the at least two overlapping spirals also being configured to start at opposite sides of the inner rim and end of the corresponding opposite sides of the suction liner; and an impeller having forward curved impeller suction side pump out vanes;

the suction liner spiral design and the forward curved impeller suction side pump out vanes configured in combination to handle solids, so as to exclude abrasive solids from an impeller/suction side liner gap by increasing the resistance to slurry flow from a high pressure area at the periphery of the impeller periphery, and expel the solids which do manage to enter the impeller/suction side liner gap by guiding the solids away from a suction eye of the impeller, so that abrasive erosion is substantially prevented to significantly reduce wear and a tight clearance is substantially maintained at the impeller/suction side liner gap between the impeller and the suction liner, which prevents degradation of pump performance through excessive leakage.

10. Apparatus according to claim 9, wherein the handle solids substantially have a weight concentration (Cw)<about 40% and/or a solids size distribution <about 200 microns.

11. Apparatus according to claim 9, wherein the impeller having an impeller face with forward curved impeller suction side pump out vanes, the impeller face being configured with an inner rim $r_i$ and an outer rim or periphery $r_o$, and the forward curved impeller suction side pump out vanes extending from an outer periphery $p_1$ of the inner rim $r_i$ and ending at the outer rim or periphery $r_o$.

* * * * *